US008136910B2

(12) United States Patent
Batalla et al.

(10) Patent No.: US 8,136,910 B2
(45) Date of Patent: Mar. 20, 2012

(54) CALIBRATION METHOD FOR A PRINTER

(75) Inventors: Pasqual Batalla, Sant Cugat del Valles (ES); Jordi Sender, Sant Cugat del Valles (ES); Marc Bautista, Sant Cugat del Valles (ES); Toni Gracia, Sant Cugat del Valles (ES); Angel Alvarez, Sant Cugat del Valles (ES); Jean Frederic Plante, Sant Cugat del Valles (ES); Alex Andrea, Sant Cugat del Valles (ES); Pascal Ruiz, Sant Cugat del Valles (ES); Joan Campderros, Sant Cugat del Valles (ES); Angel Martinez Barambio, Sant Cugat del Valles (ES); Alejandro Campillo, Sant Cugat del Valles (ES); Marcos Casaldaliga, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 1055 days.

(21) Appl. No.: 11/448,135

(22) Filed: Jun. 7, 2006

(65) Prior Publication Data

US 2007/0076039 A1 Apr. 5, 2007

Related U.S. Application Data

(63) Continuation-in-part of application No. 11/240,561, filed on Oct. 3, 2005, now Pat. No. 7,380,898.

(51) Int. Cl.
*B41J 29/393* (2006.01)
*B41J 23/00* (2006.01)

(52) U.S. Cl. ..... 347/19; 347/37

(58) Field of Classification Search ..... 347/9, 19, 347/37, 104; 358/1.4
See application file for complete search history.

(56) References Cited

U.S. PATENT DOCUMENTS

| | | | | |
|---|---|---|---|---|
| 5,898,443 | A * | 4/1999 | Yoshino et al. | 347/19 |
| 6,076,915 | A * | 6/2000 | Gast et al. | 347/19 |
| 7,380,898 | B2 * | 6/2008 | Plante et al. | 347/19 |
| 2002/0063871 | A1 * | 5/2002 | Kinas | 358/1.4 |
| 2005/0093900 | A1 * | 5/2005 | King et al. | 347/9 |
| 2005/0099470 | A1 * | 5/2005 | Nishino | 347/84 |

* cited by examiner

*Primary Examiner* — Matthew Luu
*Assistant Examiner* — Jannelle M Lebron

(57) ABSTRACT

The invention relates to a calibration method for a printer having a mechanism for advancing a medium in a direction of media advance comprising the following steps: (a) providing a printhead, the printhead having a swath height in the direction of media advance; (b) providing an estimate of either the swath height or the characteristic of the mechanism; (c) printing a base pattern on a medium using the printhead; (d) printing an overlay pattern on the medium using the printhead to form an interference pattern; (e) advance the medium of a predetermined distance using the mechanism at a time between the printing of the base pattern and the printing of the overlay pattern; (f) analyze an optical evaluation of the interference pattern; (g) evaluate as either: (i) the swath height if the characteristic of the mechanism is known or estimated; or (ii) the characteristic of the mechanism if the swath height is known or estimated.

24 Claims, 8 Drawing Sheets

CALIBRATION METHOD FOR A PRINTER

CROSS-REFERENCE TO RELATED PATENT APPLICATIONS

This application is a Continuation in part of U.S. application Ser. No. 11/240,561, filed Oct. 3, 2005, incorporated herein by reference in its entirety.

BACKGROUND OF THE INVENTION

Printers are electromechanical assemblies which are used to produce pictures, the quality of the pictures produced being highly dependent on the accuracy of the calibration of the printer. The calibration process for a printer is typically the result of a variety of methods or measurements, such calibration methods occurring during or directly following the manufacturing process, but sometimes also during the actual life of the printer to make adjustments.

PRIOR ART

A specific calibration method has for example been disclosed in EP1211084, where an interference pattern is printed, the interference pattern being scanned by a sensor, the results of the scan being analyzed to lead to the linefeed calibration of the printer.

Due to the increasing complexity of the electromechanical arrangement forming a printer it is difficult to evaluate the precise characteristics which may be extracted from the analysis of the results of a calibration method.

In the case of EP1211084, it is explained that the method allows detecting errors introduced by either an eccentric rotation of a main drive roller, or a change of diameter of the roller itself. The two errors are parts of the characteristics of the system. The logical conclusion is that the calibration method of EP1211084 does not need to be reproduced unless the actual characteristics of the roller evolve in time, or if the roller itself is changed.

The object of the present invention is to improve the outcome of the analysis of a method of calibration of the interference plot type.

SUMMARY OF THE INVENTION

This object is achieved by a calibration method for a printer having a mechanism for advancing a medium in a direction of media advance comprising the following steps:

a—providing a printhead, the printhead having a swath height in the direction of media advance;

b—providing an estimate of either the swath height or the characteristic of the mechanism;

c—printing a base pattern on a medium using the printhead;

d—printing an overlay pattern on the medium using the printhead to form an interference pattern;

e—advance the medium of a predetermined distance using the mechanism at a time between the printing of the base pattern and the printing of the overlay pattern;

f—analyze an optical evaluation of the interference pattern;

g—evaluate as either:

i—the swath height if the characteristic of the mechanism is known or estimated; or ii—the characteristic of the mechanism if the swath height is known or estimated.

BRIEF DESCRIPTION OF THE DRAWINGS

Embodiments of the invention will now be described, by way of example, and with reference to the accompanying drawings, in which.

DETAILED DESCRIPTION

Figure 1:
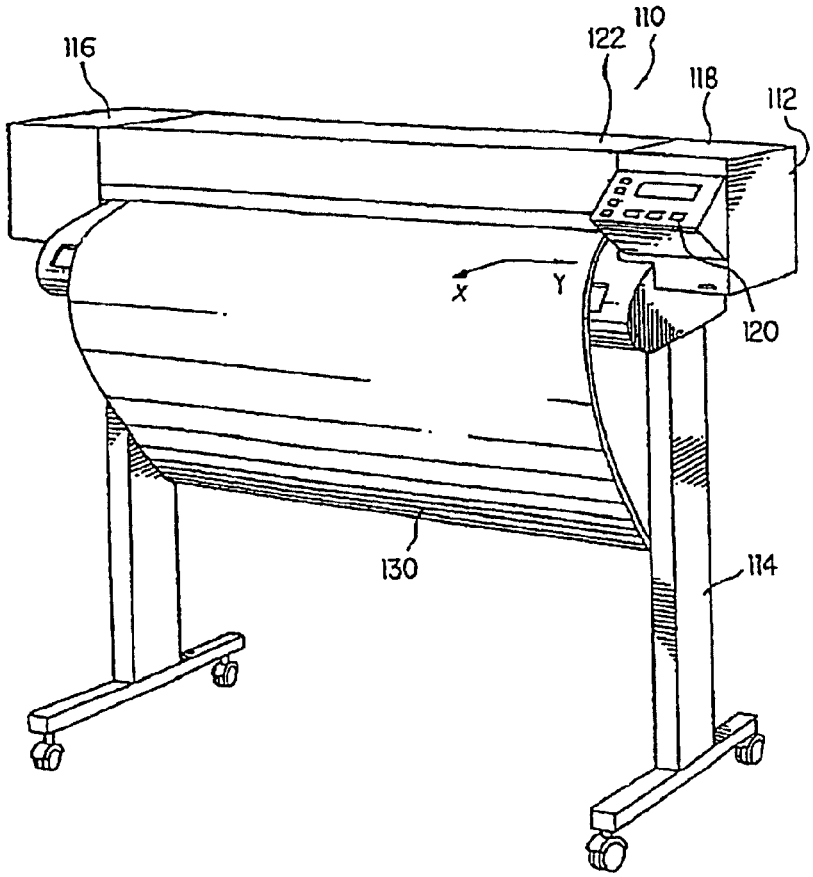
FIG. 1 is a perspective view of an inkjet printer according to an embodiment of the invention.

It was found that the interference pattern was not only dependent on the characteristics or characteristic of the mechanism for advancing the media, but also of the swath height of the printhead used to produce the interference pattern. This means that an analysis which does not take the swath height into account will lead to conclusions on the characteristic of the mechanism which are not exact or not complete. The analysis of the interference pattern in fact leads to determining a deviation from ideal which sums the deviation of both the swath height and the characteristic of the mechanism. A consequence of this is that the method of the invention may also be used for estimating the deviation of the swath height if the characteristic of the mechanism is known, and not only for determining the characteristic of the mechanism if the swath height is known. The calibration method relates to a printer. Printer should be understood as including apparatuses such as fax machines, photocopiers or all-in-one products for example. In an embodiment, the invention is used to calibrate a so called large format printers, where the swath size may be relatively large. Large format applies to formats of the B type or format larger than A4.

The printer has a mechanism for advancing a medium. This mechanism may be of a variety of nature based for example on piezo technology, vacuum or suction technology or friction for example. In an embodiment of the invention, the mechanism is of the friction type. In another embodiment, the mechanism comprises a drive roller in contact with the medium, the medium advancing as the roller rotates. The mechanism typically has an input and an output, the characteristic of the mechanism corresponding to a function associating a know input to a measured, known or estimated output. In the embodiment of the roller, the input may be the angle of rotation of the roller, the output being the corresponding distance of advance of the medium. The characteristic typically depends on a plurality of factors such as the mechanism itself, the type of medium used, the print mode, the atmospheric conditions etc. . . . The characteristic of the mechanism also typically evolves during the life or use of the mechanism.

The medium used is typically a sheet of paper, which may be a laminate, and may also be or comprise plastic resins or textile fibers, woven or non woven. The medium is typically laminar, but may have a variety of shapes, for example packages such as bottles or boxes and the like. The medium is typically flexible such as a sheet of paper but may also be rigid, such as card board or wood.

The medium is advanced by the mechanism in a direction of media advance. In the embodiment of a mechanism comprising a drive roller, the direction of media advance is normally perpendicular to the axis of the roller. The direction may be defined by mechanical guides.

A printhead is provided, the printhead having a swath height in the direction of media advance. The printhead itself may be of a variety of types as known in the art. In an embodiment, the printhead is a thermal inkjet printhead comprising a plurality of nozzles (typically between 100 and 1000 nozzles) located in the shape of an array having two or more columns, each column being parallel to the direction of advancing the medium. In another embodiment, the printhead is a piezo ink jet printhead. The swath height should be understood as the width of a swath when the printhead prints, the width being along the direction of advance of the paper. In an embodiment of the printhead where the printhead comprises columns of nozzles, the column being parallel to the direction of advance of the paper, the swath height typically corresponds to the distance separating the first functioning nozzle on one end of the printhead from the last functioning nozzle on the other end of the printhead, the columns running from one end of the printhead to the other. Typically, the precise swath height value is specific to a particular printhead and normally varies from one printhead to another (a typical distribution of a swath height population has a standard deviation of about 4 μm).

In an embodiment, the estimated swath height or characteristic of the mechanism is obtained by prior measurement of the swath height or characteristic of the mechanism respectively. Such prior measurement of the swath height may be a direct measurement made after printing a swath. Such prior measurement of the characteristic of the mechanism may be provided by a method whereby the input of the mechanism is incremented in a series of step, a printhead printing a single line on the medium being advanced at each step, the direct measurement of the space between consecutive lines representing the output related to the corresponding input, so that the function of characteristic is directly built.

In an embodiment, the estimated swath height or characteristic of the mechanism is obtained by statistical analysis of swath height or characteristic of the mechanism measurements on a representative sample of printheads or mechanisms respectively. In this case, the statistical analysis may be obtained by direct measurement on a statistical sample of printheads or mechanism, the average value being utilized in the method of the invention as estimated swath height or estimated characteristic.

In an embodiment, the step c- occurs prior to the step d-. It should however be noted that in another embodiment, the step d- occurs prior to the step d- of the invention. The method is indeed based on the analysis of the resulting interference pattern, the resulting pattern getting formed either by printing first the base pattern and second the overlay, or first the overlay and then the base pattern. The terminology of "base" pattern and "overlay" pattern should therefore not be construed in a limiting manner in so far as the "base" pattern may be printed on top of the "overlay" pattern.

In an embodiment, said printhead is a first printhead, the method being repeated using a second printhead. In such a case, it should be noted that it is assumed that the same mechanism is being used with the first and with the second printhead, so that any discrepancy between the analysis for the first printhead and the analysis for the second printhead is only and directly linked to the difference in swath height between the first and the second printhead. Indeed, in an embodiment, the method leads to estimating the swath height difference between the first and the second printhead. In an embodiment, these printheads are printing in the same color. In another embodiment, the first printhead prints in a first color and the second printhead prints in a second color, the first color being different from the second color. In such another embodiment, the swath height difference between the first and the second printhead is taken into account when printing a swath in relationship with the dominant color of the swath. It should indeed be noted that when printing a real picture, the printer should, in order to optimize printing quality, consider and take the calibration results into account. In a particular embodiment, where the first and the second printhead are located on a single carriage, the printer would have the choice of optimizing the image quality for the first or for the second printhead as far as swath height is concerned, or could even consider optimizing quality using the average swath height value between both printheads. A manner of optimizing picture quality in this case would in an embodiment consist in taking the average color of the swath into account to choose to optimize using a particular swath height. In the case of a cyan printhead and of a magenta printhead which where both submitted to the method of the invention, the printer should take the cyan printhead swath height into consideration instead of the magenta one for printing a 100% cyan swath. This applies proportionally in so far as a 50% swath could be optimized using an average between the swath height of the cyan and the swath height of the magenta. Other proportions may also be used to ponder the adjustment of the system to a specific swath height in function of the specific average color of the swath to be printed. This may be applied to a larger number of printheads, such as 4 printheads, for example, being cyan, magenta, yellow and black. More printhead may be used. In another embodiment, 12 printheads are used.

In an embodiment, the base pattern is printed using a first nozzle and the overlay pattern is printed using a second nozzle, the first and the second nozzle being separated by an inter nozzle distance along the direction of media advance, the inter nozzle distance corresponding to the predetermined distance. In this embodiment, if the base pattern is a line and the overlay pattern is also a line, and if the predetermined distance is exactly equal to the inter nozzle distance, the lines will exactly overlap. The same would apply if the base pattern was a dot and if the overlay pattern was also a dot. It should be understood that the predetermined distance corresponds to both an input and an output of the mechanism. If the system is perfect, the output will exactly correspond to the input, and to the inter nozzle distance. In a real system, there is a possibility that the output will not correspond to the input, and there is a possibility that the inter nozzle distance will not correspond to any of the input or output. In such a case, the base pattern and the overlay pattern will not exactly superpose, which leads to forming the interference pattern. In a further embodiment, the overlay pattern is printed using a group of nozzles, the group of nozzles extending along the direction of media advance, the second nozzle being located in the central zone of the group of nozzles. In this particular case, the base pattern may be used as a reference, and the overlay pattern for screening. More specifically, the base pattern may comprise a line and the overlay pattern a number of parallel and shifted steps forming a stair like structure, the stair like structure having a length along a direction perpendicular to the direction of medium advance equal to the length of the line of the base pattern, in such a manner that a given step of the stair may be coincident or overlap the line of the base pattern depending on the system variables, the printer variables being the swath height and the characteristic of the mechanism, in such a way that in a perfect printer, the step printed by the second nozzle located in the central zone would overlap the line printed by the first nozzle. In an embodiment, the group of nozzles comprises consecutive nozzles. In an embodiment, the resulting interference pattern is optically evaluated by an optical sensor. It should be noted that the sensor typically has a known or estimated field of view, which may be circular, elliptical or the like, and for which a characteristic diameter or average diameter may be defined. In an embodiment, each step of the stair forming the overlay pattern as defined above has a length corresponding to at least one characteristic diameter of the field of view. In another embodiment, each step of the stair forming the overlay pattern as defined above has a length corresponding to at least 5 times the characteristic diameter of the field of view in order to improve the stability of the sensor reading.

In an embodiment, the base pattern is printed in two steps, the medium being advanced by the mechanism between the two steps in a direction opposite to the direction of advancing the medium of the predetermined distance according to step e-. This particular embodiment allows applying the invention to the calibration of so-called "one-pass" print mode. A particular print mode is typically related to a number of passes of a printhead on a given place of the medium for obtaining the picture. A two-pass print mode implies that the printhead will pass twice at each given point of the medium to produce the final result. This clearly has a relationship to the speed of the process, in so far as a one-pass print mode would be more or less twice as fast as a two-pass print mode. The quality of a picture made using a two-pass print mode will however likely be higher that the quality of the same picture using a one-pass print mode. The number of passes also relates to the advance of the medium. For example, in a two-pass print mode, the medium is typically advanced in steps of half a swath height. In a one pass print mode, the medium is normally advanced of a full swath height. When calibrating the printer for a one pass print mode, the advance of the medium should be of en entire swath height. Indeed, in an embodiment, the medium is advanced by the mechanism between the two base pattern steps of a distance corresponding to the entire swath height. In order to produce the overlay pattern, in a further embodiment, the predetermined distance corresponds to a half of the swath height. In a particular embodiment, the base pattern comprises a line perpendicular to the direction of media advance. In a further embodiment, the overlay pattern comprises an approximation of a line at an angle to the said line of the base pattern. Typically, such an approximation is formed of steps forming stairs centered on the theoretical desired line. In another embodiment, the line approximation comprises at least one transition zone, the transition zone being obtained using a first and a second nozzle separated by a space along the direction of media advance, the first nozzle firing with a generally decreasing frequency and the second nozzle firing with a generally increasing frequency to form the transition zone. In a specific embodiment, the interference pattern is visually scanned by human eye. In a further embodiment, a reference grid is provided to improve scanning by the human eye.

In an embodiment of the invention a background is printed using the printhead, the background being printed prior to the optical evaluation. The aim of prating a background prior to optical evaluation is to increase the similarity with a "real" printing situation. It should be noted that during a normal printing procedure, the media passes by a variety of states including a first state prior to printing, a second state directly after applying the ink, and a third state after printing and drying of the ink. The media may be pre-conditioned prior to printing, for example by storage in a high humidity environment. It should be noted that in each of these states the media may have different characteristics, and even differing dimensions, due for example to media expansion due to the application of liquid ink, or due for example to media retraction after ink drying. In order to improve the accuracy of the method according to the invention, it is proposed in an embodiment to print a background as well as the interference pattern on the medium. The background may be printed at the same time as the base pattern. The background may be printed at the same time as the overlay pattern. The background may be printed during printing of the overlay pattern and during printing of the base pattern. The background may be printed prior to printing either or both of the base or overlay pattern. The background ink may be allowed to dry prior to printing either of both of the overlay or base patterns. In an embodiment, the color of the background is chosen in order to favor contrast with the color of the pattern in order to favor the optical evaluation. In an embodiment, the background is printed in yellow ink and the pattern in black. In an embodiment the background is printed in cyan ink and the pattern in black. In an embodiment, the color of the background is chosen so as to represent a statistically typical ink mix. In an embodiment, the medium used in the invention is a transparent medium, whereby a background is printed using the printhead, the background being printed prior to the optical evaluation. The impression of the background allows obtaining a reliable optical evaluation for a transparent medium, thus avoiding possible interferences due for example to the texture of a platen which would be visible through the transparent medium.

In an embodiment, the background is printed using a specific ink density. In an embodiment, the method of the invention is repeated using different backgrounds using different ink densities.

In an embodiment, the resulting interference pattern is optically evaluated by an optical sensor comprising one or more LED's, whereby the background is printed in a color chosen in function of the color or colors of the LED or LED's comprised in the sensor.

Referring to FIG. 1, a printer 110 includes a housing 112 mounted on a stand 114. The housing has left and right drive mechanism enclosures 116 and 118, and a cover 122. A control panel 120 is mounted on the right enclosure 118. A print media 130 is positioned along a media axis denoted as the X axis. A second axis, perpendicular to the X axis, is denoted as the Y axis.

Figure 2:
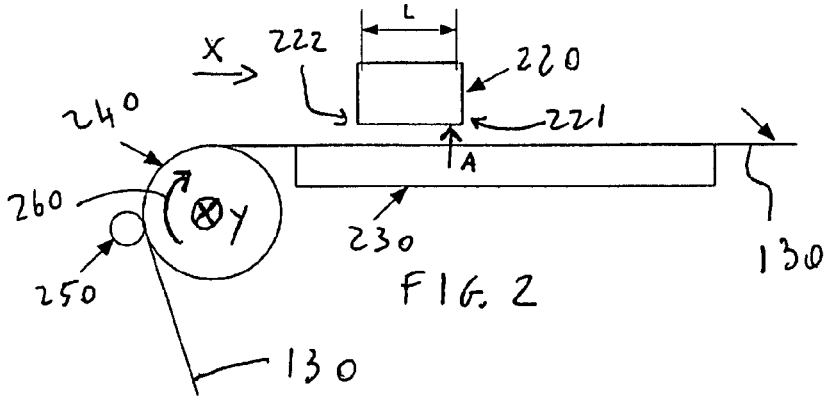
FIG. 2 is a schematic section of a printer according to an embodiment of the invention.

FIG. 2 schematically represents the media 130 together with a printhead 220, a platen 230, a main drive roller 240 and a pinch roller 250. The system normally is functioning in the following manner: medium 130 is extracted from a roll of medium and passes between the pinch roller 250 and the main drive roller 240.

In this case, the main drive roller is motorized. When turning in the direction indicated by arrow 260, the medium 130 is being advanced onto the platen 230. The medium 130 is held against the platen 230 by a vacuum suction system which is not represented here. The direction of media advance is the X direction or X axis. The mechanism for advancing the medium comprises the main drive roller 240. The printhead 220 scans the medium along the Y direction or Y axis which is in this case perpendicular to the X axis.

Figure 3:
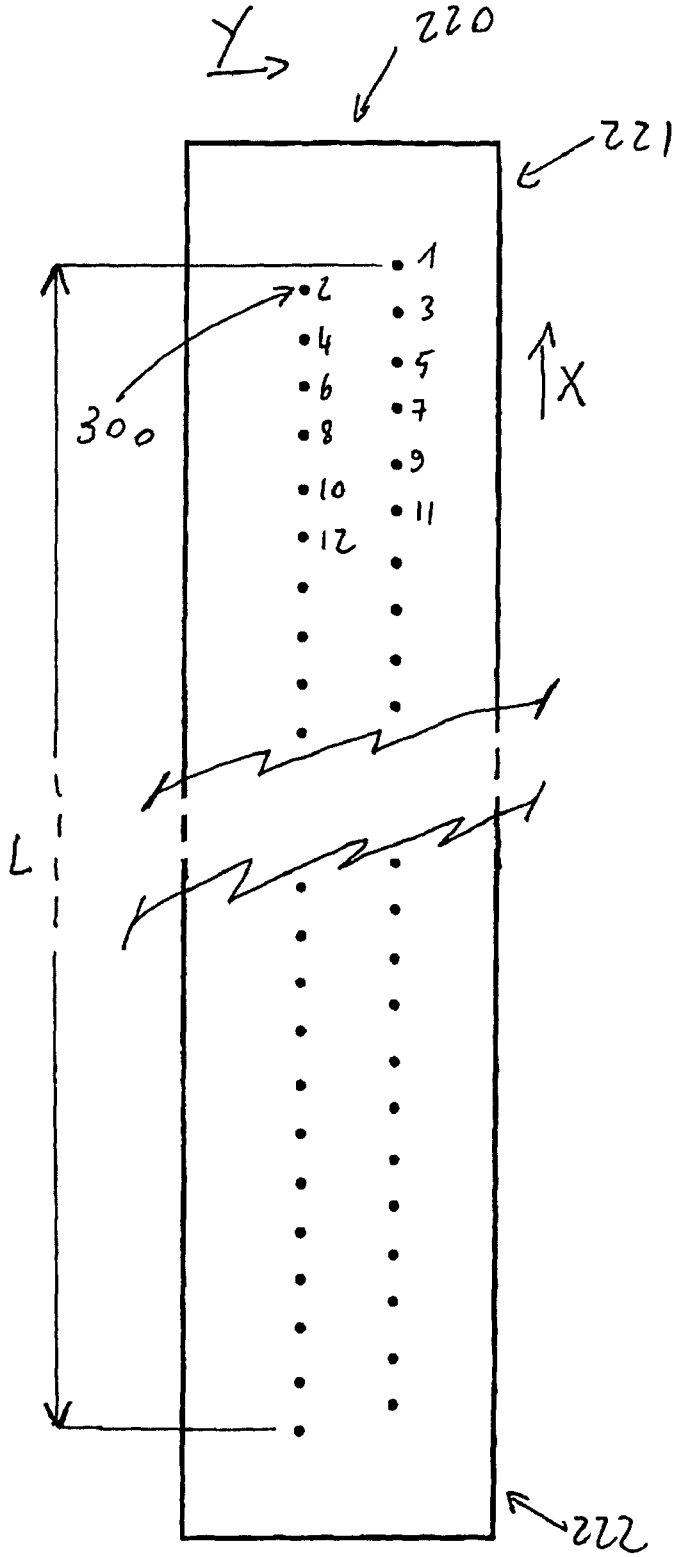
FIG. 3 is a schematic view of a printhead according to an embodiment of the invention.

FIG. 3 schematically represents the bottom face of the printhead 220 as seen following the direction of arrow A represented in FIG. 2. The printhead 220 carries a number of nozzles 300. In this case the head carries 500 functioning and active nozzles. In this case the nozzles are forming 2 columns, each column carrying 250 functioning and active nozzles. Not all nozzles are represented on FIG. 3: only the 2 ends of the printhead are represented. The nozzles are the printing elements, and as such define the swath height of the printhead. The swath height is the length L represented in FIGS. 2 and 3 taken along the X axis or medium advance direction which corresponds to the maximum width of a swath printed by the printhead when the printhead moves along the Y direction or scanning direction. If all nozzles of the printhead are functional and active, the swath height corresponds to the distance separating the extreme nozzles on both end of the printhead along the X axis. It should be noted that the swath height would be smaller if one or more nozzles situated at an extreme end of the printhead are malfunctioning or inactive. It should also be noted that the printhead typically comprises nozzles in excess towards the ends 221, 222 of the printhead to be able to shift the zone of active nozzles towards one end or the other for calibration purposes (this particular aspect of the calibration is not discussed here). The swath height is typically varying from one printhead to another. The swath height may be determined for a particular printhead by measuring directly the height of a swath printed by the printhead.

In this particular embodiment, the advance mechanism is typically non perfect, having for example a non perfect radius and having its rotation axis not necessarily corresponding to its geometrical axis. In theory, rotation of the drive roller of a determined angle alpha should cause an advance of the medium of a distance of alpha multiplied by the radius of the roller. This is however dependent on the rotation axis and radius variation defaults of the drive roller, as well as on the type of medium used (the type of medium having indeed an influence on the friction between the drive roller and the medium, which has itself an influence on the actual transmission of the force causing the displacement). The characteristic of the roller corresponding to the functional relationship between the input, in this case the rotation angle, which may be controlled by an encoder, and the output, which is the corresponding displacement of the medium, is in theory a straight line. The defaults of the system mean however that the real characteristic does normally not correspond to the expected one and should be measured and be specific to a type of medium and to a specific printer. There are known manners of measuring this characteristic, for example by printing one line using a particular nozzle of the printhead, advance the medium by rotating the drive roller by a known angle, and thereafter print another line using that exactly same nozzle. The distance between the two lines being measured, it corresponds to the medium advance, which can then be associated to the angle to build the characteristic of the mechanism. It should be noted that the measurement of the distance between the two lines is made along the X axis, which is no the scan axis of the printer, so that such a measurement cannot be directly made using a scanner scanning along the scan axis. This means that such a measure implies turning the paper around, or measure using a sensor which is not scanning along the scan axis.

The characteristic may also be estimated statistically by measuring the characteristic for example as above for a large number of rollers, and take the average of the population as estimated characteristic.

Figure 4:
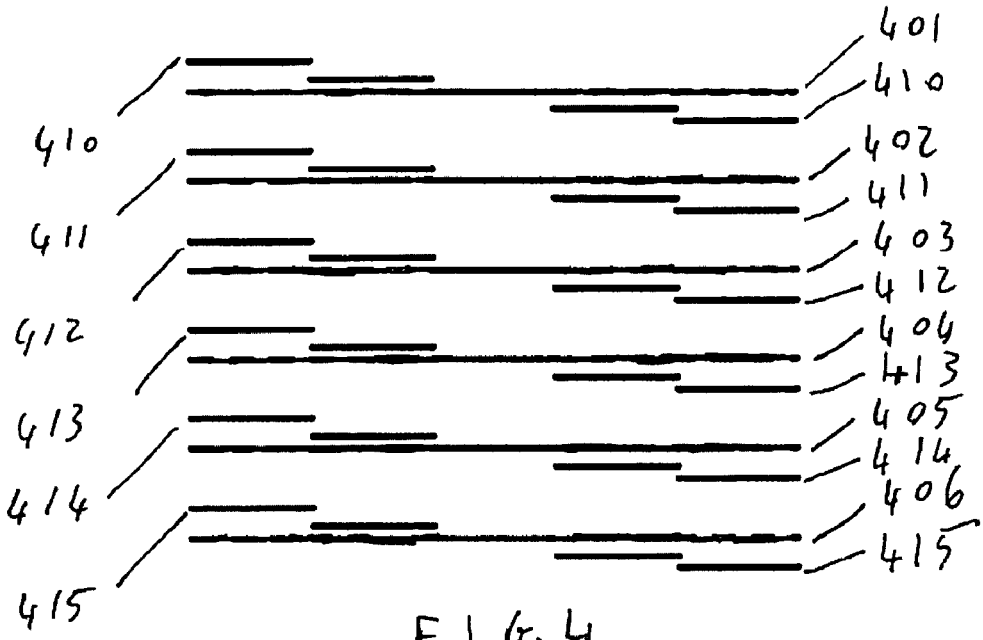
FIG. 4 is a schematic view of an interference pattern according to an embodiment of the invention.

One of the mechanism characteristic or of the swath height being known or estimated, an interference pattern as represented on FIG. 4 is printed as follows according to a first embodiment of the invention. In a first pass of the printhead, the printhead prints lines 401 to 406. These lines are printed using 6 nozzles separated by 10 nozzles. In the example, the printhead has two columns of nozzles, the nozzles being staggered. We will assume that the nozzles of a first column are described with odd numbers starting from the end 221 of the printhead 220 further away from the drive roller 240 (nozzles 1, 3, 5, 7 etc. . . . ) and that the nozzles of a second column are described with even numbers starting from the same end 221 (2, 4, 6, 8, etc. . . . ) such that along the X axis the nozzles follow each other in the order 1, 2, 3, 4, 5 etc. . . . , the nozzle number 1 being located on the end 221 of the printhead further away from the drive roller. Line 401 is printed by nozzle 6, line 402 is printed by nozzle 16, and line 403 is printed by nozzle 26 etc. . . . , so that the distance separating the lines corresponds to 9 nozzles. The paper is then advanced by the method of a distance of half an inch, corresponding in this case to 250 nozzles, the pen being 500 dots per inch pen, the pen having 500 functioning nozzles. In the invention, pen is used a synonym for printhead. The overlay pattern is then formed by stairs 410 to 415. The overlay pattern is made of stairs, each stair being formed of steps, the steps being printed by consecutive nozzles, the central step of each stair being printed by a nozzle located exactly 250 nozzles from the nozzle having printed the corresponding line of the base pattern. This means that stair 410 is printed using nozzles 251 to 261. Only the central steps printed by nozzles 254 to 258 are represented. Stair 411 is printed using nozzles 261 to 271 etc. . . . If the system is perfect, the step printed by nozzle 255 will exactly overlap the line printed by nozzle 6, as illustrated on FIG. 4. The actual real aspect of the resulting interference pattern is illustrated on FIG. 5, where all steps of the stairs are represented. As evidenced by FIG. 5, in case of a perfect system, the lighter column of the resulting interference pattern is the central column 500. The more there is an overlap between the line of the basic pattern and a step of the overlay pattern, the darker the column is.

Figure 5:
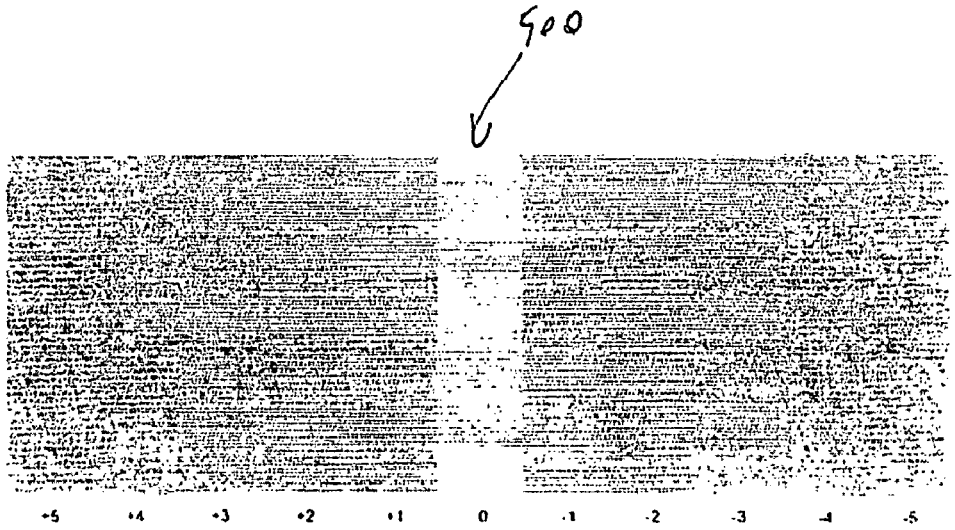
FIG. 5 is an interference pattern according to an embodiment of the invention.
Figure 6:
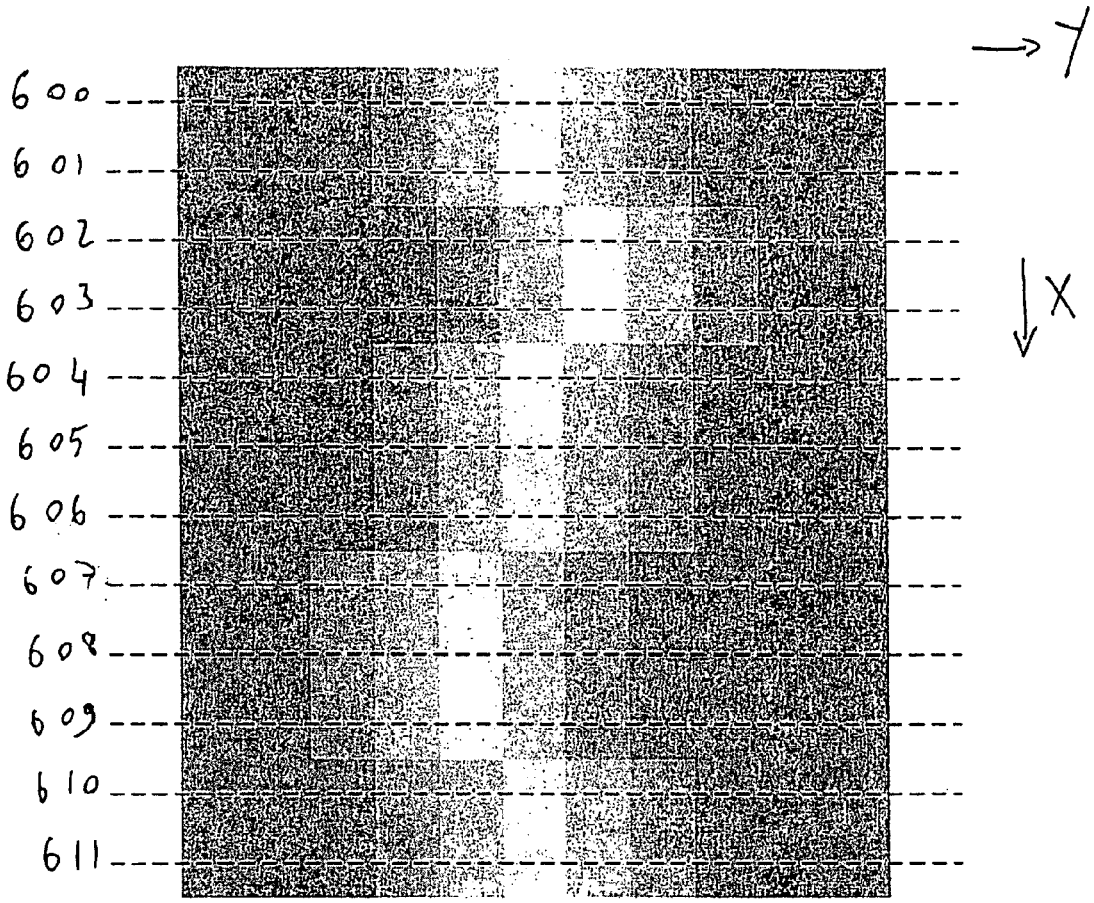
FIG. 6 is a schematic view of an interference pattern according to an embodiment of the invention.
Figure 7:
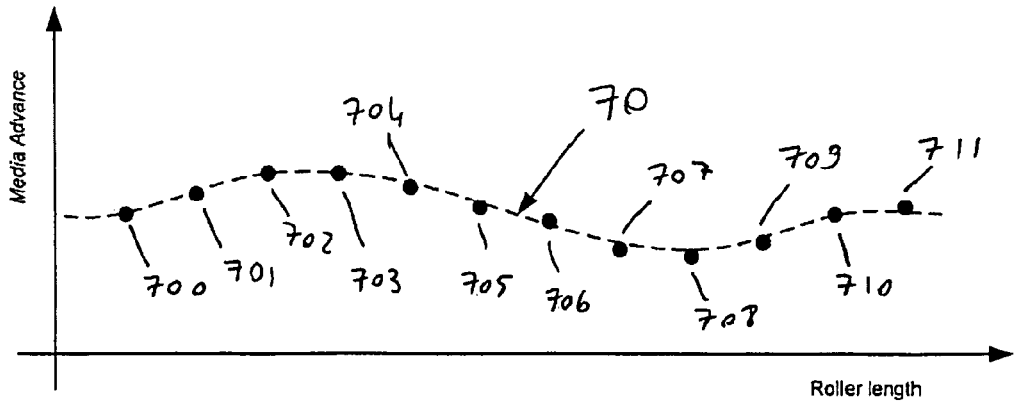
FIG. 7 is a representation of a measurement obtained by an embodiment of the method of the invention.

A graph corresponding to the graph of FIG. 5 may be provided a different number of times. If the swath height of the print head is known, the graph may for example be produced a number of times to correspond to a complete cycle of the mechanism. Such a succession of graphs is represented in FIG. 6. It may be observed in FIG. 6 that the lighter column is not always the central column, meaning that there are deviations from the ideal profile or characteristic of the advance mechanism. A profile may be extracted by scanning the graph of FIG. 6 along the doted lines 600 to 611. The lines 600 to 611 are not real printed lines but represent the path followed by an optical sensor or scanner, which is in this embodiment mounted on a carriage together with the printhead. In this case, the sensor will scan the graph progressively as it gets produced by the printhead. In this case, the complete drive roller has revolved between the scan line 600 and the scan line 610. The position of the drive roller is known in the printer of this embodiment using an encoder. This means that a complete characteristic of the roller may be extracted by analysis of the results corresponding to the scans of lines 600 to 610. A result of the scan is represented in FIG. 7. The curve 70 represents the effective media advance for a determined and constant input or angle of rotation of the drive roller, in function of the point of the perimeter of the roller considered. In an ideal case, the curve would be a straight horizontal line corresponding approximately to the average value of the real curve. The type of curve obtained in FIG. 7 is typical of a roller which would for example not be completely circular of cross section but slightly elliptical. The actual characteristic of the roller is deduced by integrating the error in function of the angle of rotation of the roller. In this embodiment, the input of the function is the angle of rotation of the roller, controlled by the encoder, the output being the media advance. As explained, for each angle advance, the error in advance distance is the distance between the centre of the ideal interference pattern (marked as 0 in FIG. 5) and the point 910 of FIG. 9, the distance being taken along the Y axis. Each point 700 to 711 of the curve corresponds to the position of the white column in the respective scanning line 600 to 611 of FIG. 6.

Figure 8:
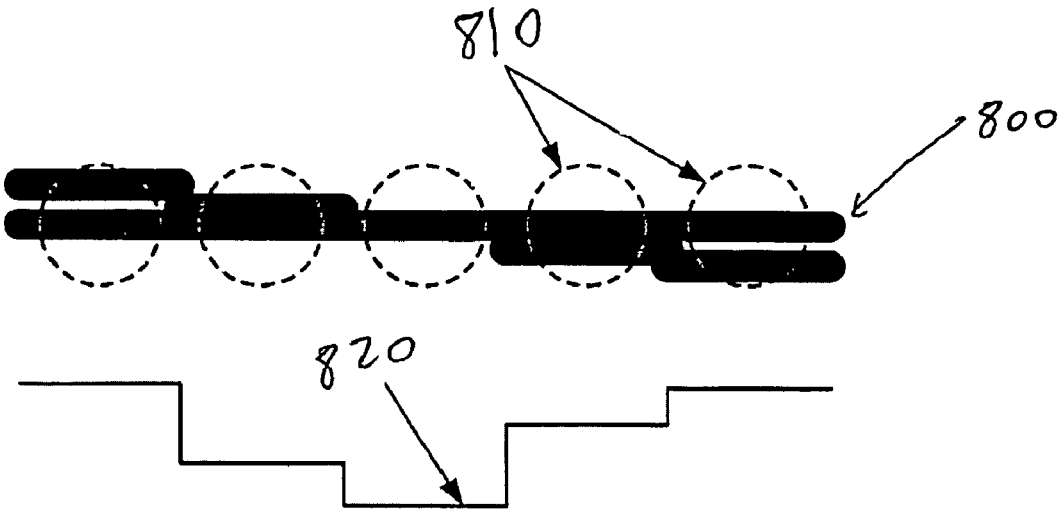
FIG. 8 is a schematic view of an interference pattern according to an embodiment of the invention.
Figure 9:
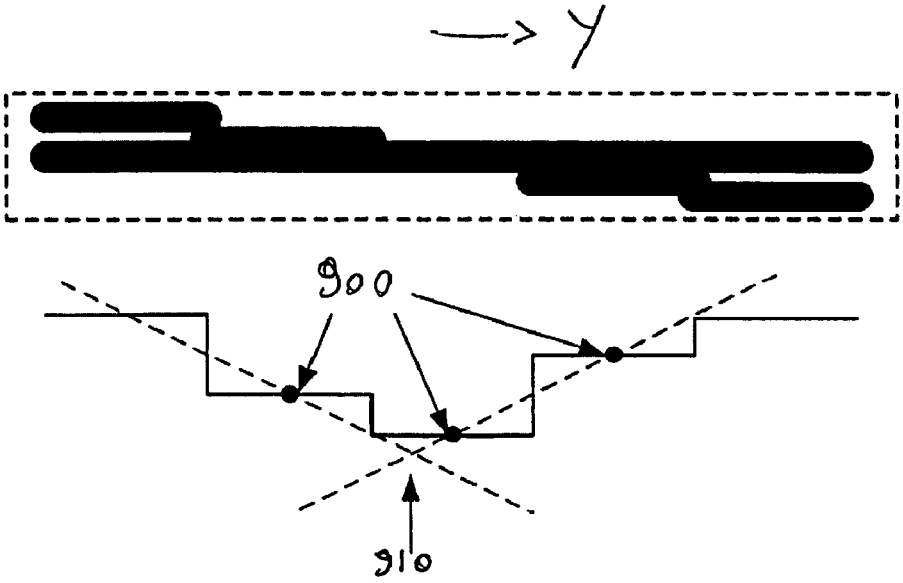
FIG. 9 is a schematic view of an interference pattern according to an embodiment of the invention.

In FIGS. 8 and 9, the construction of the curve 70 is explained in more details. A particular instance of the interference pattern 800 is represented. The optical sensor takes measurements in a series of areas 810, typically one measurement per step. The resulting output of the sensor is as represented in curve 820. The point of lowest intensity may be deduced using the points 900 situated at the middle of each step for producing a new point 910 by extrapolation, this point corresponding to one of the points 700 to 711 of FIG. 7. Other type of extrapolation may be used.

It should be noted that the interference pattern may be built differently, for example as described in EP1211084, hereby incorporated by reference.

It should be noted that this mode of execution of the invention uses an advance of the media which is of half the swath height of less. A second embodiment of the invention will now be described where the media advance is of a full swath height.

Figure 10A:
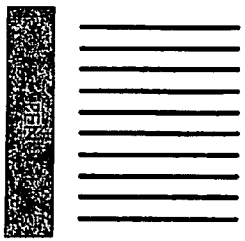
FIG. 10 A-E are schematic view of interference patterns according to an embodiment of the invention.
Figure 10B:
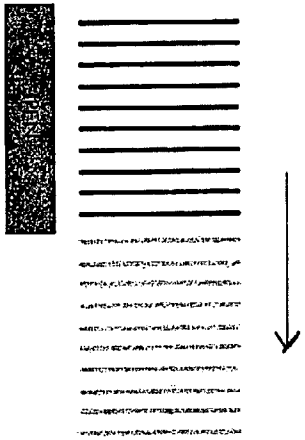
Figure 10C:
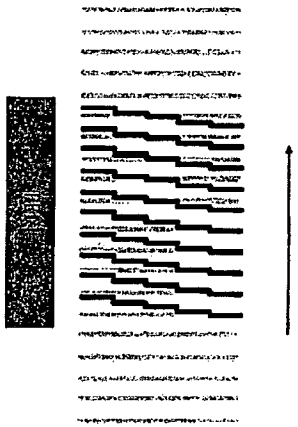
Figure 10D:
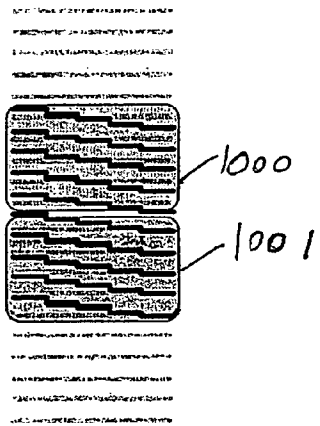
Figure 10E:
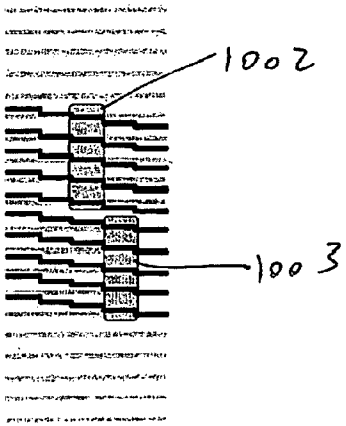

The second embodiment is illustrated in FIGS. 10A to 10B. In FIG. 10A, the first part of a base pattern is printed in a first base pattern step and consists of a set of lines similar to the set of lines 401-406 of FIG. 4. In this particular embodiment, the pattern is produced over the whole length of the pen, whereby the lines are again separated by nine nozzles, whereby these nine nozzles are not fires. In this embodiment, the base pattern is completed in a second step as illustrated in FIG. 10B after a media advance in the direction of the arrow corresponding to the full swath height. The print of the second step is of the same nature as the print of the first step. The overlay pattern is produced in FIG. 10C after a media advance in the direction opposite to the media advance occurring between the first and the second print of the base pattern, the media advance of FIG. 10C being in this case of half a swath height, but being in any case sufficient for overlaying both the first and the second base pattern. It should in fact be noted that in another embodiment, only some of the lines or steps represented on FIG. 10C are actually printed, the only constraint being that some overlap between each base and the overlay pattern occurs in order to produce the interference pattern between the first base pattern and the overlay pattern, and between the second base pattern and the overlay pattern. The overlay pattern itself is printed in one pass of the printhead. Two interference zones are created as illustrated in FIG. 10D. The first zone 1000 corresponds to the interference between the first base pattern and the overlay pattern, the second zone 1001 corresponding to the interference between the second base pattern and the overlay pattern. In FIG. 10E, the clearest columns 1002 and 2003 of each zone are marked. In an ideal system, the two columns should be aligned. In a real system, the distance separating the first and the second column corresponds to the deviation of the advance mechanism for an advance of, in this embodiment, a full swath height. It should be noted that larger advances could even be considered, as long as a part of each of the first and second base patterns may be overlaid by an overlay pattern. In this embodiment, the overlay pattern is of the same nature as the overlay pattern used in the embodiment illustrated in FIG. 4.

It should be noted that in both embodiments above, the intrinsic precision of the measurement is defined at least by the distance which separates two steps of the overlay pattern, this distance corresponding to the minimal distance along the X axis between two nozzles (for example between nozzle 1 and nozzle 2). It should also be noted that the length of the steps, which corresponds to the width of the columns, mean that an extrapolation is as illustrated in FIG. 9 should be made in order to obtain an improved result.

In a third embodiment, the intrinsic precision is improved and the improved result is obtained without extrapolation.

Figure 11:
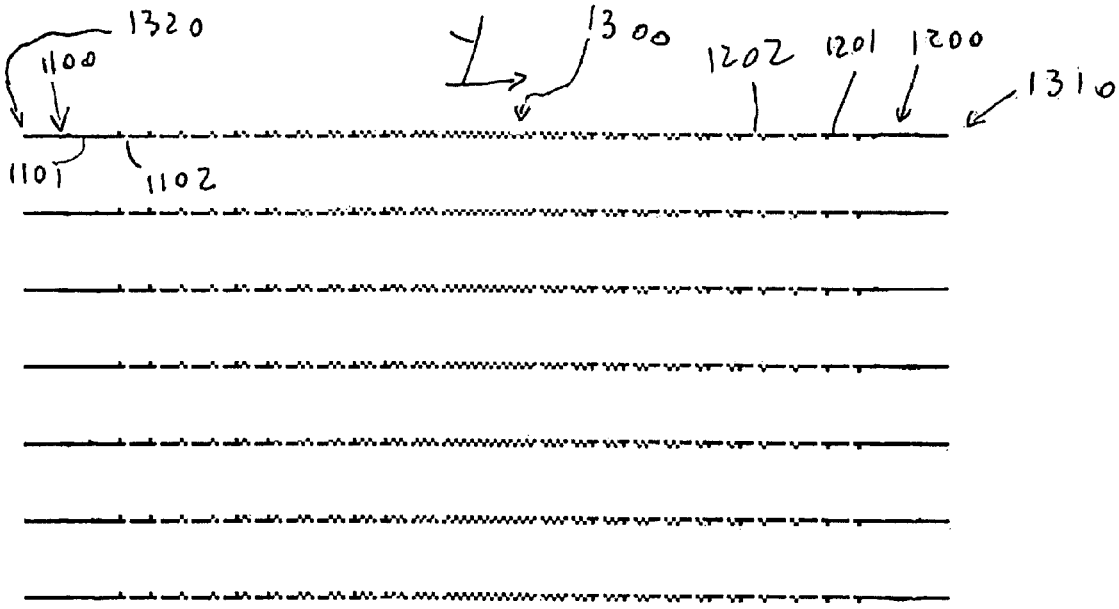
FIG. 11 is a schematic view of an overlay pattern according to an embodiment of the invention.

In the third embodiment, the overlay pattern is not made of steps but made of the approximation of a line at an angle to the corresponding line of the base pattern, the line of the base pattern being along the Y direction, i.e. perpendicular to the direction of media advance. In the third embodiment, the approximation of the line at an angle being built with steps similar to the steps of FIG. 4, whereby one of every two steps is formed by alternating segments 1101 and blanks 1102 whereby the concentration of blank spaces increases progressively relative to the concentration of segments, or whereby the size of the blanks progressively increases relative to the size of the segments in the positive sense of the Y direction, in such a manner that the step fades away in the Y direction indicated in FIG. 11. The other steps are built in the opposite manner, by alternating segments 1201 and blanks 1202 whereby the concentration of blank spaces decreases progressively relative to the concentration of segments, or whereby the size of the blanks progressively decreases relative to the size of the segments, in such a manner that the step fades in (in opposition to fading away) along the same direction of the Y axis as represented on FIG. 11. The result of this effect is to improve the optical rendering of the step pattern so that the stair like curve becomes more similar to a straight line at an angle to a line of the base pattern. A result was to improve intrinsic precision and allow for an improved reading of the interference pattern without need for interpolation. The "column" effect appearing with the steps is indeed becoming continuous.

Figure 12:
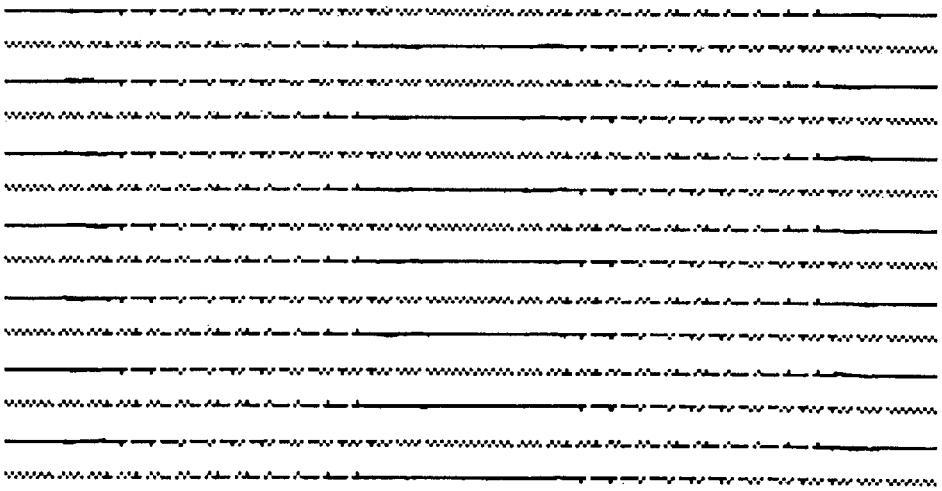
FIG. 12 is a schematic view of an overlay pattern according to an embodiment of the invention.
Figure 13:
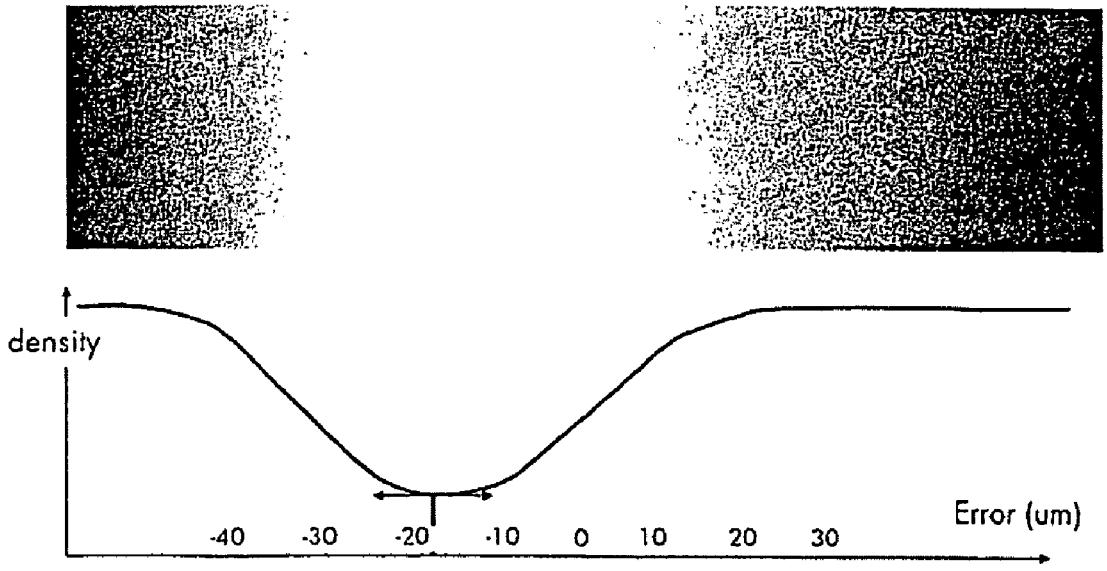
FIG. 13 is a global view of an interference pattern according built using the overlay pattern of FIG. 12 and a representation of the measurements obtained by an embodiment of the method of the invention for this interference pattern.

It should however be noted that the optical intensity of the overlay pattern was found to be higher in the centre 1300 of the transition fading zone than in the edges 1310 and 1320 due to the fact that the drops forming the print overlap when contiguous, such as towards the edges, and do not overlap or overlap to a lesser extend in the central zone 1300, so that the local concentration of printed area is higher in the central zone than at the edges. This non homogeneity of the optical intensity may have a negative influence on the reading by the optical sensor, and was corrected in a fourth embodiment where an additional overlay pattern was inserted between the previously described overlay pattern, but in opposition of phase so as to re-equilibrate the optical density, as illustrated in FIG. 12. It should be noted that both in FIGS. 11 and 12 only two steps of the overlay pattern equivalent to the overlay of FIG. 4 are represented. The base pattern itself remains unchanged. An example of interference pattern obtained using the interlaced pattern of FIG. 12 as overlay pattern is represented in FIG. 13 together with the curve representing the optical density, from which the error in medium advance is deduced by the position of the minimum of the curve. Such a variation on building the overlay pattern to avoid step discontinuities may be applied to any embodiment of the invention.

An interference pattern built using an overlay pattern formed of fading steps allows a human user to read directly or detect directly by eye the point of minimum optical density. A grid may be provided, being either pre-printed, printed or provided as a transparent overlay to ease reading of the interference pattern. This allows a user to calibrate its own printer without need of complex tooling or manipulation.

In a fifth embodiment, the method of the first embodiment is applied to a printer having 4 print heads being a cyan, a magenta, a yellow and a black printhead. The method is repeated using the same printer for each printhead separately. The advance mechanism being a constant, the only difference between the four results obtained is due to the swath height difference between the print heads. The swath difference between 2 particular print heads is obtained by measuring any displacement of the position of the white column or of the optical intensity minimum between the interference pattern produced by a first and a second printhead. The displacement is the swath height difference between both printhead.

In the case of a printer carrying a plurality of print heads located on a same carriage, a compromise needs to be made as to the swath height which will be taken into account for printing a swath by scanning the carriage. A first option is to consider the average swath height. Another option is to consider the average color composition of the swath to be printed and either choose the swath height of the printhead corresponding to the particular color which is most used for printing the swath, or taking into account the respective weight of the colors in the color composition to build a composite average swath height. For example, if the swath will be 70% cyan and 30% magenta, the swath height correction should be made considering for 70% the swath height correction of the cyan print head and for 30% the swath height correction of the magenta print head.

All publications and existing systems mentioned in this specification are herein incorporated by reference.

Although certain methods and products constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

The invention claimed is:

1. A calibration method for a printer, comprising:

printing one or more interference patterns on a medium using a printhead configured to print on the medium a swath having a swath height in a direction;

scanning the one or more interference patterns using a scanner within the printer to produce scan data; and determining, from the scan data and the swath height, a characteristic of a roller, wherein the characteristic includes an amount of media advance, in the direction, that occurs when the roller rotates by a predetermined amount, wherein the amount of media advance is determined for a plurality of locations on the roller.

2. A calibration method according to claim 1, further comprising determining an error of the printer when moving the medium and an error of the swath height of the printhead, wherein these errors are caused by the characteristic of a roller.

3. A calibration method according to claim 1, further comprising printing a background on the medium at the same time as printing the one or more interference patterns.

4. A calibration method according to claim 1, wherein the scanner is mounted on a carriage together with the printhead, and configured to scan the one or more interference patterns as the one or more patterns are being printed by the printhead.

5. A calibration method according to claim 1, further comprising:

redetermining the characteristic by repeating the printing, scanning, and determining when a different printhead is installed in the printer.

6. A calibration method according to claim 1, wherein the medium is transparent, and wherein a background prevents the scanner from viewing through the transparent medium features other than the one or more interference patterns.

7. A calibration method according to claim 1, wherein printing the one or more interference patterns on the medium comprises printing a first pattern and then advancing the medium before printing a second pattern on the medium.

8. A calibration method according to claim 7, wherein the second pattern is an overlay pattern that includes multiple lines in a staggered alignment, and wherein the determining includes determining, from the scan data, a discrete reading indicative of an alignment of the first and second patterns.

9. A calibration method according to claim 7, wherein the second pattern is an overlay pattern that is a continuous scale including multiple lines in a parallel configuration, and wherein the determining includes determining, from the scan data, a continuous transition indicative of an alignment of the first and second patterns.

10. A calibration method according to claim 1, further comprising printing a background on the medium, wherein the interference patterns do not comprise the background.

11. A calibration method according to claim 10, wherein the background is allowed to dry before printing the one or more interference patterns.

12. A calibration method according to claim 10, wherein the color of the background is a statistically typical ink mix representative of a typical printing situation.

13. A printer, comprising:

a printhead configured to print one or more interference patterns on a medium, the printhead configured to print on the medium a swath having a swath height in a direction;

a scanner configured to scan the one or more interference patterns to produce scan data; and a controller configured to determine, from the scan data and the swath height, a characteristic of a roller, wherein the characteristic includes an amount of media advance, in the direction, that occurs when the roller rotates by a predetermined amount, wherein the amount of media advance is determined for a plurality of locations on the roller.

14. A printer according to claim 13, wherein the controller is further configured to determine an error of the printer when moving the medium and an error of the swath height of the printhead based on the characteristic of a roller.

15. A printer according to claim 13, wherein the printhead is further configured to print a background on the medium at the same time as printing the one or more interference patterns.

16. A printer according to claim 13, wherein the scanner is mounted on a carriage together with the printhead, and configured to scan the one or more interference patterns as the one or more patterns are being printed by the printhead.

17. A printer according to claim 13, wherein the swath height is determined by printing with the printhead a swath having the swath height on a medium and measuring the swath height on the printed medium.

18. A printer according to claim 13, wherein the swath height is determined through statistical analysis of printed swath heights produced by a corresponding representative sample of printheads.

19. A printer according to claim 13, wherein printing the one or more interference patterns on the medium comprises printing a first pattern and then advancing the medium before printing a second pattern on the medium.

20. A printer according to claim 19, wherein the second pattern is an overlay pattern that includes multiple lines in a staggered alignment, and wherein the controller is further configured to determine, from the scan data, a discrete reading indicative of an alignment of the first and second patterns.

21. A printer according to claim 19, wherein the second pattern is an overlay pattern that is a continuous scale including multiple lines in a parallel configuration, and wherein the controller is further configured to determine, from the scan data, a continuous transition indicative of an alignment of the first and second patterns.

22. A printer according to claim 13, wherein the printhead is further configured to print a background on the medium, wherein the interference patterns do not comprise the background.

23. A printer according to claim 22, wherein the background is allowed to dry before printing the one or more interference patterns.

24. A printer according to claim 22, wherein the color of the background is a statistically typical ink mix representative of a typical printing situation.

* * * * *